US005437447A

United States Patent [19]

Rigutto

[11] Patent Number: 5,437,447

[45] Date of Patent: Aug. 1, 1995

[54] GOLF PUTTER

[76] Inventor: Martin A. Rigutto, 17735 105th Pl. SE. #F-202, Renton, Wash. 98055

[21] Appl. No.: 94,839

[22] Filed: Jul. 20, 1993

[51] Int. Cl.[6] ..... A63B 69/36; A63B 53/04; A63B 53/06

[52] U.S. Cl. ..... 273/164.1; 273/171; 273/173; 273/167 A

[58] Field of Search ..... 273/164.1, 169, 171, 273/173, 174, 167 A, 164.2, 186.2, 187.4; D21/217, 218, 219

[56] References Cited

U.S. PATENT DOCUMENTS

| | | | |
|---|---|---|---|
| 1,046,343 | 12/1912 | Smith | D21/219 X |
| 1,253,700 | 1/1918 | McLaughlin | 273/173 |
| 1,617,090 | 2/1927 | Worthington | 273/167 A |
| 2,056,335 | 10/1936 | Wettlaufer | 273/173 X |
| 2,463,798 | 3/1949 | Paisley | D21/219 X |
| 2,592,013 | 4/1952 | Curley | 273/171 |
| 2,846,228 | 8/1958 | Reach | 273/169 |
| 3,333,854 | 8/1967 | White | 273/164 |
| 3,547,445 | 12/1970 | Hardesty | 273/173 |
| 4,121,832 | 10/1978 | Ebbing | 273/171 |
| 4,194,739 | 3/1980 | Thompson | 273/79 |
| 4,540,178 | 9/1985 | Johnson et al. | 273/169 |
| 4,618,149 | 10/1986 | Maxel | 273/79 |
| 4,749,197 | 6/1988 | Orlowski | 273/173 |
| 4,881,739 | 11/1989 | Garcia | 273/167 |
| 4,884,808 | 12/1989 | Retzer | 273/77 |
| 5,082,278 | 1/1992 | Hsien | 273/164 |
| 5,154,425 | 10/1992 | Niskanen | 273/173 X |
| 5,303,922 | 4/1994 | Lo | 273/173 |

OTHER PUBLICATIONS

Gold World, Feb. 1988, Wilson Supplement p. 9, group of putters on top row.

Golf Digest, Jul. 1981, p. 87.

*Primary Examiner*—George J. Marlo

*Attorney, Agent, or Firm*—Klarquist Sparkman Campbell Leigh & Whinston

[57] ABSTRACT

The golf club putter comprises a body having a face piece attached to a front portion of the body. The pitch of the face piece may be changed by removing the face piece and replacing it with a face piece having a different pitch. The body comprises a rearwardly projecting flange and a curved bottom surface having upwardly curved front and rear surfaces. The face piece is elevated as a result of the upwardly curved front bottom surface so that a golf ball may be stricken above its center to create a forward top-spin on the ball.

28 Claims, 1 Drawing Sheet

GOLF PUTTER

FIELD OF THE INVENTION

The present invention relates to the field of golf clubs and particularly to golf putters.

BACKGROUND OF THE INVENTION

In the game of golf, putting is a critical part of the game. A putter must be useful in a wide variety of golfing conditions, such as putting on long or uneven grass surfaces and slopping greens. A putter also must accommodate varying stances, swinging styles and strengths of golfers. Many attempts have been made to develop golf putters which accommodate the variety of golfing conditions and special needs of golf players. However, there remains a need for an improved putter.

One example of a prior art putter is shown in U.S. Pat. No. 4,881,739 to Garcia. The Garcia golf putter has a flat bottom portion and a curved forward surface which terminates in an elevated leading edge which imparts an over-spin to the golf ball when struck therewith. Because the Garcia putter has what is in effect a striking edge instead of a flat surface, uniform putting is believed more difficult. In addition, the vertical rear wall of the Garcia putter would tend to hang up on taller grass or non-uniformities in the surface, for example when putting from the fringe of the green, interfering with the putting stroke.

A golf putter having a flat bottom, vertical rear surface and a removable face bar is disclosed in U.S. Pat. No. 3,333,854 to White. The face bar is removed to expose an upper edge to impart an over-spin to the golf ball. White also discloses a semicircular sighting device with sight lines on the upper surface of his putter in a color which contrasts with the black putter head. White also suffers from drawbacks such as described above in connection with Garcia.

The use of removable weights in a golf club putter is shown in U.S. Pat. No. 4,121,832 to Ebbing. The patent teaches the use of weights to enable a player to experiment with different swing weights until the player arrives at a desired weight. The club head includes a removable face plate having a cavity formed on the inside thereof for receiving removable weights. The face plate has a striking surface formed with either a negative or positive pitch (loft) relative to the vertical.

A need remains for a versatile golf putter that is suitable for a variety of golfing conditions.

SUMMARY OF THE INVENTION

The invention comprises a club body with a bottom surface with upwardly curved front and rear surface portions. Consequently, the putter tends to ride smoothly over grass and irregularities in the ground for a smoother putting stroke. The upwardly curved front surface elevates a strike surface of the face of the putter so that a golf ball may be stricken by the strike surface above its center to create a forward top-spin on the ball. A forward top-spin is desirable because it assists in causing the golf ball to travel in a straight line. The rear portion of the body has a rearwardly projecting flange to balance the weight distribution of the golf club head.

The pitch of the striking surface of the putter may be changed by removing the face piece and replacing it with a face piece having a different pitch. The weight of the club may be adjusted by machining or otherwise removing material from a rear surface of the face piece.

Further, the balance of the club (for example, the heel to toe balance) may be changed by controlling the location from which the material is removed from the face piece.

The club also has a stroke guide in the form of a band across the top surface of the club which has a width which approximates the diameter of a golf ball. During a stroke, the golfer's eye sees the latent image of the guide band as the club moves, which assists the golfer in moving the putter along the desired stroke path.

It is accordingly one object of the invention to provide an improved golf putter.

The present invention relates to the above object, features and advantages of the putter individually, as well as collectively.

DETAILED DESCRIPTION OF THE INVENTION

Figure 1:
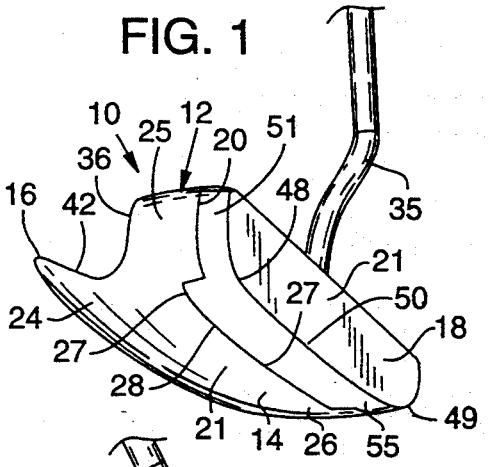
FIG. 1 shows a perspective of a preferred embodiment of the golf putter of the present invention looking from below.
Figure 2:
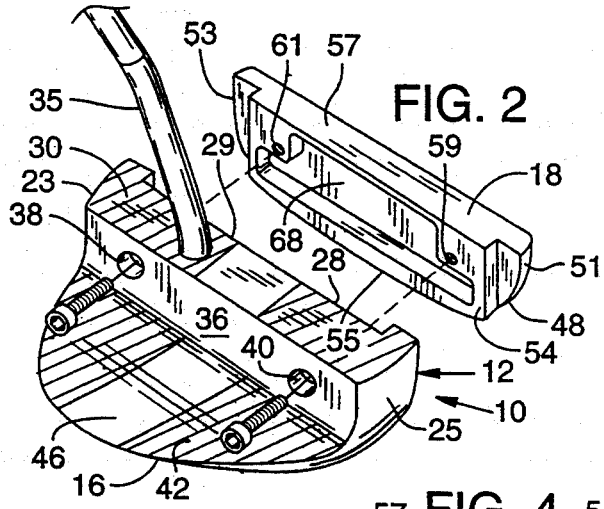
FIG. 2 shows a perspective exploded view of the golf putter of FIG. 1 looking from above.
Figure 3:
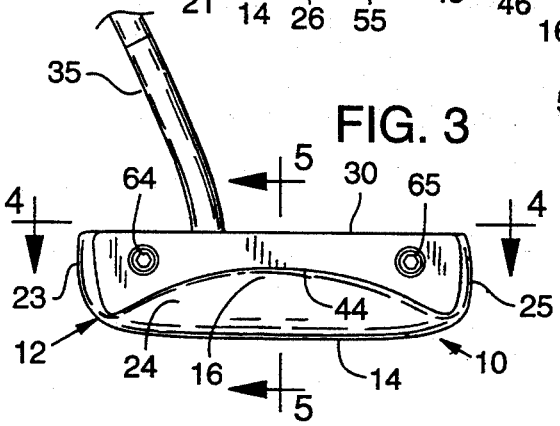
FIG. 3 shows a rear view of the putter of FIG. 1.
Figure 4:
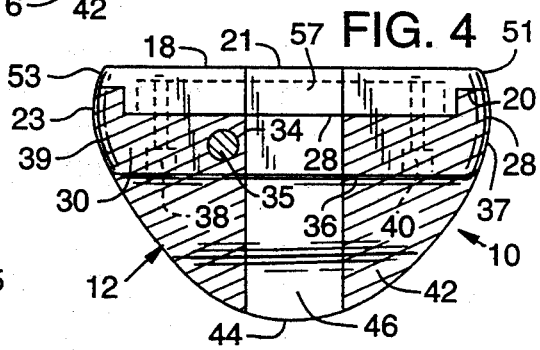
FIG. 4 shows a top view of the putter of FIG. 1 looking in the direction of line 4—4 of FIG. 3.
Figure 5:
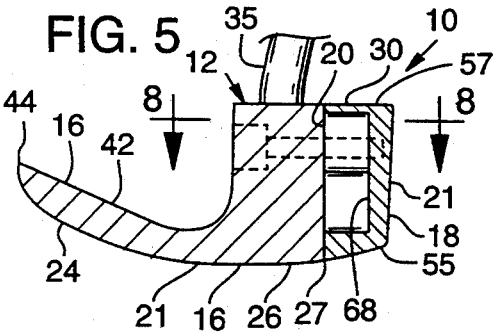
FIG. 5 shows a cross-sectional view of the putter of FIG. 1 taken along line 5—5 of FIG. 3.

The figures illustrate a preferred embodiment of a golf putter 10 of the present invention. The golf putter 10 generally comprises a body 12 having a curved bottom surface 14 and a rearwardly projecting flange 16. The body is preferably formed in one piece and is most preferably, but not necessarily, made of a non-resilient durable material such as steel. Of course, the body may be formed of multiple piece construction and made of other materials such as wood, ceramics and polymeric materials, if desired. Body 12 is preferably, but not necessarily, a dark color such as black for purposes explained below.

The curved bottom surface 14 has an upwardly curved rear bottom surface portion 24 and an upwardly curved front bottom surface portion 26. The rear bottom surface 24 extends from a low point or nadir point 21 rearwardly to form a bottom portion of flange 16. Similarly, the front bottom surface 24 extends from nadir point 21 to a lower edge 27 of an upright, preferably vertical front portion 20.

Because the front and rear-most portions of the club are elevated relative to the lower-most portion of the club, during a strike the putter does not tend to hang up on longer grass (such as at the fringe of the green) or other obstacles which could interfere with the stroke. The smooth continuous curve of the lower surface of the club also minimizes the possibility of the club hanging up or catching during a putting stroke.

The bottom surface 14 also forms a curved surface sideways extending from a first side or heel side surface 23 to an opposite second side or toe side surface 25 of body 12. Thus, bottom surface 14 is curved from the rear to the front of the putter head and from the heel to the toe of the putter head.

The side surfaces 23 and 25 extend from bottom surface 14 to a flat horizontal top surface 30. The side surfaces 23 and 25 are tapered from front portion 20 to an upright back surface 36, which may be vertical, at a rear portion of the putter head.

The back surface 36 extends from top surface 30 down to an upwardly inclined upper surface 42 of flange 16. The upper surface 42 projects rearwardly and upwardly from the lower portion of back surface 36 and terminates at a rounded peripheral edge 44. Among other things, the flange 16 functions to counter balance the front portion 20 of the club head 10 and a removable face piece 18 attached thereto as the head is being swung by a golf player (not shown). The back surface 36 has two horizontal screw holes 38, 40 formed therein and projecting through body 12 from back surface 36 into a face-piece receiving recess 28 formed in the opposite front portion 20.

The recess 28 extends from lower edge 27 up to an upper front edge 29 of top surface 30 of body 12. The top surface 30 is substantially flat and defines a shaft receiving opening 34 for threadably receiving a golf shaft 35. It is to be understood that opening 34 may be either vertical or inclined to angle shaft 35 inserted therein to the left, right, forward or backward depending on the special needs of the golf player.

A stripe 46 is provided on the upper surface of the putter head. Stripe 46 is a color which preferably contrasts with and is lighter than the color of the upper surface of the putter body. Most preferably stripe 46 is white on a black body. The stripe 46 may be placed centrally on body 12 and extends from peripheral edge 44 across upper surface 42 and top surface 30. Of course, stripe 46 may be of a color different than white and body 12 may have no stripe placed thereon. Stripe 46 preferably has a width which is about the diameter of a golf ball (not shown). As the golf player looks at and swings golf club head 10, the player's eyes retain the latent image of stripe 46 as a line (due to the high contrast between the white line and the black background) which assists the golfer in maintaining a straighter stroke so that the golf ball may be hit more accurately.

The removable face piece 18 is optional and is attached to front portion 20 of body 12. The face piece is preferably, but not necessarily, made of a metal such as brass. However, the face piece may also be made of other materials such as wood, ceramic or moldable plastic materials. The face piece 18 has a flat strike surface 21 for striking golf balls. The strike surface 21 has rounded lower corners 49 and a curved bottom edge 50.

Face piece 18 further comprises curved side surfaces 51, 53, an upwardly curved bottom portion 55 and a flat top surface 57. Face piece 18 also comprises an inner portion 52 for engaging front portion 20 of body 12. The inner portion 52 has a protrusion member 54 dimensioned to matchingly fit inside recess 28 of body 12. The protrusion member 54 extends from top surface 57 to bottom portion 55 of face piece 18 and has two threaded holes 59, 61 formed therein.

The protrusion member 54 may be attached to front portion 20 by fasteners, such as allen head screws 64, 65 inserted through the holes 38, 40 at the back surface 36 and then threaded into threaded holes 59, 61, respectively formed in protrusion member 54. A large central cavity 68 is formed in protrusion member 54. Cavity 68 may be used to hold weights or otherwise in adjusting the weight and the weight distribution of the putter, such as explained in detail below.

When face piece 18 is attached to body 12, the face piece is aligned or flush with body 12 to form smooth contiguous surfaces. For example, side surfaces 51, 53 of face piece 18 and side surfaces 23, 25 of body 12 are flush. Also, bottom portion 55 and front bottom surface 24 is flush. This flushness reduces the risk of the club head 10 hanging up on the grass as the club head moves over the grass.

A significant advantage of the curved front bottom surface 24 and the flush bottom portion 55 is that they together elevate strike surface 21 off the green so that the strike surface 21 may strike the golf ball above the center of the golf ball to impart a forward top-spin on the ball. An over-spin is often desirable because the ball tends to travel in a straight line and there is less risk of undesirably lifting the ball off the green which could cause the ball to bounce in an uncontrolled manner. In addition, a flat strike surface allows the golfer to vary the elevation of the putting stroke somewhat while still impacting the ball with a flat portion of the strike surface. This contributes to uniform putting results.

Figure 6:
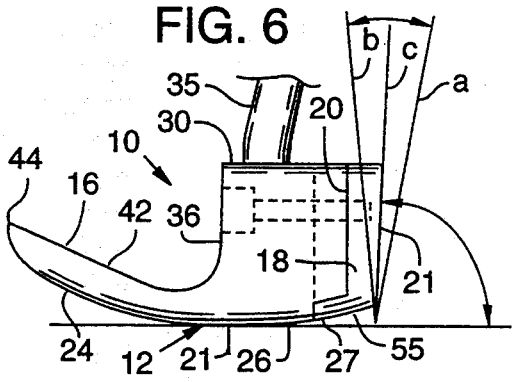
FIG. 6 shows a side view of the putter of FIG. 1 and the pitch of a face piece attached thereto.
Figure 7:
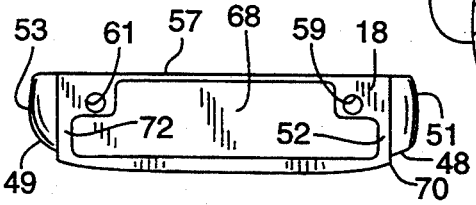
FIG. 7 shows a rear view of the face piece shown in FIG. 6.

As shown in FIGS. 6, the pitch or the angle of strike surface 21 may be changed by replacing face piece 18 with another face piece having a different pitch. The pitch may be defined as the degree of inclination of the striking surface with respect to the vertical. The face piece may either have a positive pitch (line a in FIG. 6) or negative pitch (line b). For example, the strike surface 21 may have a +20° pitch or a −20° pitch. Of course, other angles may be used ranging from 0° to over 60° pitch. A striking surface having a positive pitch angle tends to create more forward top-spin than a striking surface having a negative pitch. A negative pitch may be used when it is desirable to lift the golf ball such as when the grass surface between the golf ball and the golf hole is very uneven. Of course, the striking surface 21 may be substantially vertical (see line c of FIG. 6) i.e. having no positive or negative pitch.

The weight of golf club head 10 may be varied by using a lighter or heavier material for body 12 and face piece 18. The weight may also be adjusted by varying the size of the central cavity 68 formed within protrusion member 54. The larger the size of cavity 68, the lighter the putter head.

Figure 8:
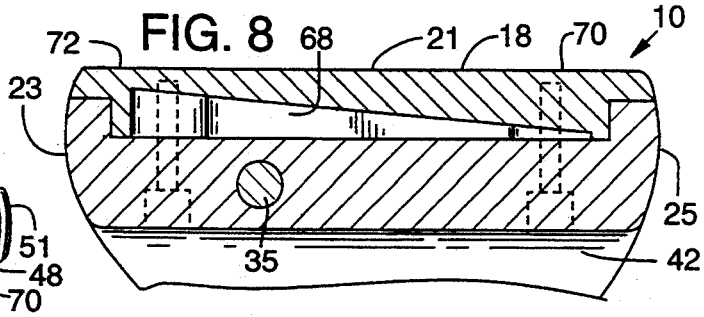
FIG. 8 shows a cross sectional view of a putter in accordance with the present invention, taken along line 8—8 of FIG. 5, and illustrating one approach for varying the weight (distribution of the face piece to adjust the balance of the putter).

The weight distribution of putter head 10 may also be adjusted by using a face piece having toe, heel or neutral weighting. For example, the putter head 10 may be made toe heavy by adding more weight to cavity 68 at a toe portion 70 or removing weight from cavity 68 at a heel portion 72 (see, for example, FIG. 8). Similarly, the club head may be made heel heavy by adding more weight to heel portion 72 or removing weight from toe portion 70. As is apparent, the weight of club head may be distributed neutrally or equally by adjusting the weight of either toe portion 70 or heel portion 72 to create an even balance between toe portion 60 and heel portion 62.

While the present invention has been described in accordance with the preferred embodiment, it is to be understood that certain substitutions and alternations may be made thereto without departing from the spirit and scope of the claims.

I claim all such modifications which fall within the following claims:

1. A golf putter comprising:

a body having a front and rear, and a bottom surface, the bottom surface being upwardly curved toward both the front and the rear of the body;

the body including a front surface and an upright rear surface spaced from the front surface; and the body including a flange which projects rearwardly and upwardly from a position below the upright rear surface.

2. A golf putter according to claim 1 in which the bottom surface has a lower-most portion, the putter including a removable face piece with a front ball striking surface, the face piece being attached to the front of the body and elevated from the lowermost portion of the body as a result of the upwardly curved bottom surface, the face piece being fastened to the body by fasteners extending through the upright rear surface and into the face piece without penetrating the front surface of the face piece.

3. A golf putter according to claim 2 wherein the face piece has an upwardly curved bottom portion and is provided with a recess behind at least a portion of the ball striking surface.

4. A golf putter according to claim 2 wherein the ball striking surface is an elevated flat striking surface.

5. A golf-putter according to claim 1 wherein the front of the body has a recess formed therein.

6. A golf putter according to claim 1 wherein the rear of the body includes an upright rear surface.

7. A golf putter according to claim 6 wherein the upright rear surface has an opening formed therein, the opening extending through the body to the front thereof.

8. A golf putter according to claim 1 wherein the body has first and second side surfaces, the side surfaces being tapered.

9. A golf putter according to claim 8 wherein the bottom surface is curved extending from the first to the second side surface.

10. A golf putter according to claim 1 wherein the body comprises a flat top surface, the top surface having a shaft receiving hole formed therein.

11. A golf putter according to claim 1 wherein the flange has an upwardly inclined upper surface.

12. A golf putter according to claim 1 wherein the flange has a substantially round peripheral edge.

13. A golf putter comprising:

a body having a front and rear;

the body having a bottom surface being upwardly curved toward both the front and rear of the body;

a flange projecting rearwardly and upwardly from a lower portion of the rear of the body; and the rearwardly projecting flange including an upper surface which is inclined upwardly from the rear portion of the body.

14. A golf putter according to claim 13 wherein the putter further includes:

a recess defined by the front of the body;

a removable face piece having a front ball striking surface, the face piece being attached to the front of the body, the face piece having a projection member extending toward the rear of the face piece for engaging the recess; and wherein the flange has a rounded periphery.

15. A golf putter according to claim 14 wherein the face piece has a cavity formed therein.

16. A golf putter according to claim 14 wherein the face piece is attached to the front of the body by fasteners, the fasteners being inserted through holes formed at the rear of the body and above the flange.

17. A golf putter according to claim 14 wherein the face piece has a striking surface, the striking surface having a pitch.

18. A golf putter according to claim 17 wherein the striking surface has a positive pitch.

19. A golf putter according to claim 17 wherein the striking surface has a negative pitch.

20. A golf putter according to claim 14 wherein the face piece has a bottom portion, the bottom portion being flush with the bottom surface when the face piece is attached to the front of the body, wherein the bottom portion is upwardly curved, and wherein the face piece has a flat upper surface, the body also having a flat upper surface which is flush with the upper surface of the face piece, the putter including a shaft extending upwardly from the flat upper surface of the body.

21. A golf putter according to claim 14 wherein the face piece has a toe portion and a heel portion, the toe portion being heavier than the heel portion.

22. A golf putter according to claim 14 wherein the heel portion is heavier than the toe portion.

23. A golf putter according to claim 14 wherein the face piece is made of metal.

24. A golf putter according to claim 14 wherein the projection member has a cavity formed therein.

25. A golf putter according to claim 14 wherein the face piece is flush with the body when the protrusion member is disposed inside the recess.

26. A golf putter comprising:

a body having a front and rear, the body comprising a top surface, a rearwardly projecting flange and a bottom surface, the body having a first color;

the rearwardly projecting flange having an upwardly inclined upper surface;

the bottom surface being upwardly curved toward both the front and rear of the body; and a stripe extending across the upper surface and the top surface, the stripe having a second color, the second color being lighter than the first color.

27. A golf putter according to claim 26 wherein the body is substantially black and the stripe is white.

28. A golf putter according to claim 26 wherein the golf putter further includes a face piece attached to the front of the body.

* * * * *